US005647590A

United States Patent [19]

Walker et al.

[11] Patent Number: 5,647,590

[45] Date of Patent: Jul. 15, 1997

[54] GAME BALL FOR URBAN USE

[75] Inventors: Alan D. Walker, Somers, Conn.; Ron LaLiberty, Dudley, Mass.

[73] Assignee: Lisco, Inc., Tampa, Fla.

[21] Appl. No.: 342,565

[22] Filed: Nov. 21, 1994

[51] Int. Cl.[6] ..... A63B 37/06; A63B 37/12

[52] U.S. Cl. ..... 473/601

[58] Field of Search ..... 273/58 C, 58 A, 273/DIG. 5, DIG. 8, DIG. 20, 60 R, 60 A, 60 B

[56] References Cited

U.S. PATENT DOCUMENTS

| | | | |
|---|---|---|---|
| 4,463,951 | 8/1984 | Kumasaka et al. | 273/58 A |
| 4,772,019 | 9/1988 | Morgan | 273/60 B |
| 4,840,378 | 6/1989 | Molitor | 273/60 B |
| 5,300,325 | 4/1994 | Nealon et al. | 273/235 A |

OTHER PUBLICATIONS

Sports Trend, Feb. 1993, p. 132, "New Products".

*Primary Examiner*—Vincent Millin
*Assistant Examiner*—Charles W. Anderson

[57] ABSTRACT

A game ball having a softer core and abrasion resistant cover is particularly well suited for play on hard pavements and cement in inner city areas. The ball has a polyurethane foam core formed from a mixture of 100 parts polyol and 33–40 parts isocyanate. The core has a compression of 0.06–0.07 inches when subjected to a force of 10 lbs. and a coefficient of restitution at 88 feet per second of less than 0.45, and preferably 0.30–0.40. A molded polyvinyl chloride plastisol cover is formed over the core, resulting in a game ball for which the ratio of the coefficient of restitution of the ball to the coefficient of restitution of the core is in the range of about 0.90–0.99. The cover preferably is a durable molded cover having a Shore A hardness of about 60–70 and a tensile strength of about 1,400–1,800 psi. The ball of the invention has restricted flight characteristics and is particularly well suited for use on smaller ball fields.

20 Claims, 1 Drawing Sheet

GAME BALL FOR URBAN USE

FIELD OF THE INVENTION

The present invention relates generally to game balls and more particularly is directed to game balls well suited for use on hard pavement or concrete in urban areas.

BACKGROUND OF THE INVENTION

Many inner city play areas are smaller than regulation size baseball or softball fields and frequently are partially or fully paved with blacktop or concrete. Regulation game balls not only can outdistance the size of such playing fields, but also do not possess the durability to withstand the harsh surface condition of these paved areas.

Reduced injury factor or "safety" balls have been used in limited playing field areas as well as for indoor and outdoor training, and for competitive use by young players. Such balls exhibit severely limited flight characteristics and/or do not have the requisite durability for harsh surface conditions. They typically have a core which is formed of a foamed polymer (U.S. Pat. No. 4,772,019) or a soft cloth (U.S. Pat. No. 4,261,565) and a cover which is made of cloth. U.S. Pat. No. 4,772,019 discloses a safety ball with a cold cure polyester-polyether based urethane core and a nylon cover stitched with chain or herringbone stitching. The cover is permitted to move or be resiliently displaced relative to the core to control the rebound characteristics of the ball. U.S. Pat. No. 5,253,865 also is directed to a safety ball with a foam urethane core and a flexible cloth cover. Other known "softer" game balls have a kapok core covered with a synthetic or natural stitched leather cover or may have a hollow spherical core as disclosed in U.S. Pat. Nos. 4,880,233 and 5,123,659.

The advantage of reduced injury factor balls is that they have a reduced impact pressure, and therefore are less apt to "sting" upon hitting a player. Furthermore, they are less likely to cause damage if they are hit or thrown against an object or structure. However, conventional safety balls also often have poor durability, including the tendency to severely deform from their original spherical shape. Furthermore, the covers of stitched safety balls tend to separate from their cores. Therefore, conventional safety balls are not well suited for long-term use or for use on hard surfaces such as concrete or pavement often found in inner city play areas.

SUMMARY OF THE INVENTION

An object of the present invention is to provide a durable game ball of consistent performance for use on hard pavement or concrete. Included in this object is the provision for a game ball with a softer and slower center or core for use on smaller playing ball fields and a more durable cover for use on harder surfaces while retaining all other characteristics of a conventional regulation game ball.

Another object of the present invention is to provide a game ball of the type described having a reduced coefficient of restitution coupled with excellent abrasion resistance.

A further object of the present invention is to provide a ball having the characteristics set forth above yet is suitable for use in competitive play.

Other objects will be in part obvious and in part pointed out more in detail hereinafter.

These and related objects are achieved by providing a highly durable game ball comprising a foam core having a low coefficient of restitution and a cover formed over the core and fixedly secured thereto. The core comprises a urethane foam made from a mixture of 100 parts polyether polyol and 33–40 parts isocyanate. It has a compression of 0.06–0.07 inch when subjected to a force of 10 pounds, and a coefficient of restitution (C.O.R.) at 88 feet per second of less than 0.45, with a practical lower C.O.R. limit of about 0.30. The cover imparts minimal reduction to the C.O.R. of the core such that the ratio of the C.O.R. of the covered ball to the C.O.R. of the core itself is at least about 0.90 or preferably in the range of about 0.95–0.99.

In a preferred form of the invention, the cover is molded directly over the core for secure attachment thereto such that the core and cover act as one unit with no relative movement therebetween. The cover, made of a polyvinyl chloride plastisol, typically has a thickness range of 0.025–0.075 inch, and more preferably a range of 0.040–0.060 inch. The Shore A hardness of the cover material preferably is about 60–70, the material exhibiting a tensile strength of about 1,400–1,800 psi and an elongation of about 300–400%. The preferred core, which contains 35–38 parts isocyanate per 100 parts polyol.

Another form of the invention is a method for making the durable low coefficient game ball described herein. The method comprises the steps of forming a polyurethane core of the above-mentioned materials under conditions sufficient to result in a core having compression and C.O.R. values substantially the same as those required by the finished ball. The polyvinyl chloride plastisol cover is then molded directly to the core to result in a ball for which the ratio of the C.O.R. of the covered ball to the C.O.R. of the core is about 0.90–0.99. The molding results in a two piece construction that exhibits the characteristics and properties of a one piece ball, but with significantly enhanced durability for urban use.

The invention accordingly comprises the several steps and the relation of one more of such steps with respect to each of the others and the article possession the features, properties, and relation of elements exemplified in the following detailed disclosure.

BRIEF DESCRIPTION OF THE DRAWING

The FIGURE shows a game ball according to the invention.

DETAILED DESCRIPTION OF THE INVENTION

Figure 1:
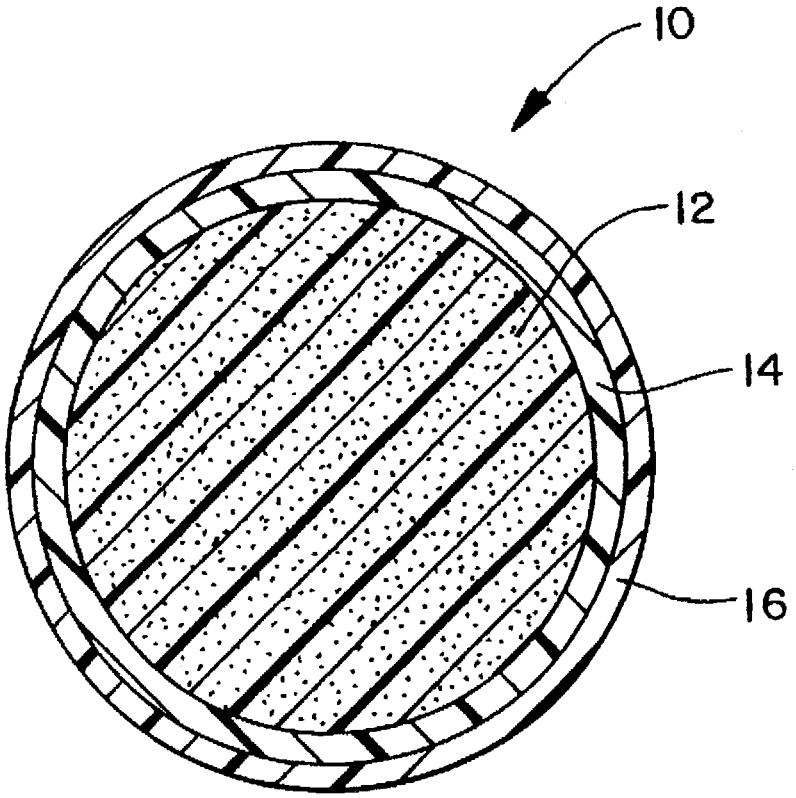

For clarity of description and ease of understanding, the invention will be described in connection with softballs although it will be understood that other game balls can advantageously employ the features of the present invention.

A ball's coefficient of restitution (C.O.R.) is the ratio of the relative velocity of the ball after and before direct impact. One way to measure the coefficient of restitution is to propel a ball at a given speed against a rigid, hard surface, and measure its incoming velocity and outgoing velocity. The coefficient of restitution is defined as the ratio of the outgoing velocity to incoming velocity of a rebounding ball and is expressed as a decimal. As a result, the coefficient of restitution can vary from zero to one, with one being equivalent to a fully elastic collision and zero being equivalent to an inelastic collision.

The softball of the invention meets all Softball Association specifications for restricted flight softballs since it has a C.O.R. of less than 0.470, albeit preferably substantially less than that upper C.O.R. limit for such balls. The ball has a C.O.R. of less than 0.45 with a practical lower limit of about 0.30 and a range of 0.30–0.40. A conventional regulation softball has a C.O.R. of about 0.50. The softball has a circumference of 11⅞ to 12½ inches and a weight of 6¼ to 7 ounces (171.9–198.5 grams). As shown in the FIGURE, the ball 10 is formed from a core 12 and a surrounding cover 14 which provides for a minimal reduction to the coefficient of restitution of the finished softball 10. Most cover materials will effectively reduce the coefficient of restitution of a softball core to some extent. However, by maintaining the desired properties of the core 12 and transferring these properties to the finished softball 10 to the greatest extent possible, the ability to achieve the intended design characteristics of the ball is maximized and improved quality control is obtained while achieving enhanced durability.

The core 12 of the softball is made of a solid, closed cell semi-rigid foam material and is formed of a polyurethane obtained from a mixture of 100 parts of a polyether polyol and 33–40 parts of isocyanate, with the preferred amount if isocyanate being 35–38. The core 12 is spherical with its circumference depending upon the thickness of the cover 14 which is to be applied thereto. Typically, the core 12 circumference is about 11½–11¾ inches.

The softball 10 of the present invention has a softer core 12 than conventional softballs. The compression of the core 12 is 0.06–0.07 inches when subjected to a force of 10 pounds, while conventional softballs have cores with compressions of only about 0.01–0.02 inches. This core softness, associated with the lower C.O.R., results in a ball 10 that does not rebound off the bat as fast as the harder core balls, thus reducing its flight distance characteristics.

The vinyl resin cover 14 of the softball 10 preferably is molded on the core 12 to form an integral bond therewith. The cover 14 is molded in situ on the core from a polyvinyl chloride plastisol material and is sufficiently durable for street play. The vinyl plastisol is a homogeneous mixture or blend of a polyvinyl chloride homopolymer dispersion and a diisononyl phthalate ester plus appropriate stabilizers and pigments known in the art. The premixed polyvinyl alcohol plastisol is placed in a preheated hemispherical mold having a desired cover pattern, slush cast and gelled to provide the desired cover thickness and then molded to the core 12. The molding operation may employ the techniques described in U.S. Pat. No. 4,822,041, which is directed to a molded ball, such as a softball, with simulated stitching and simulated stitch holes adjacent the outer edges of the stitching and the formulation disclosed in U.S. Pat. No. 4,840,378, the disclosures of which are incorporated herein by reference. The molded cover 14 preferably has a Shore A hardness of 60–70, a tensile strength of 1,400 to 1,800 psi and an elongation of 300–400%. The thickness of the cover 14 falls within the range of about 0.025–0.075 inch and preferably within the range of 0.040–0.060 inch. These properties provide a highly durable ball which will withstand repeated use on a hard surface such as pavement or concrete. The cover 14 can be molded to have and, in fact, does have a texture and feel which replicates that of a leather softball cover.

Optionally, a sealant-type thin layer protective coating 16 may be placed over the cover 14 of the softball 10 as set forth in U.S. Pat. No. 5,091,265 incorporated herein by reference. For a molded ball, the coating 16 preferably is sprayed after molding the cover 14. For a ball with a stitched cover, the coating 16 can be applied to the cover material prior to stitching, but typically is sprayed in the same manner as a molded cover 14, i.e., after the cover has been secured on the core 12 of the ball. The coating 16 itself is very thin, typically having a thickness of only 5–10 mils. The coating material preferably is polyurethane, but can be any material which enhances the grip characteristics of the ball, such as tackiness and softness, enhances hitting characteristics by improving a player's ability to impart spin to the ball, and/or retards the build-up of dirt on the ball.

A laboratory pound test is used as a measure of the ball's stability and durability. This test involves repeatedly striking a ball with a standard size weight dropped from a set height. The ball 10 is subject to a series of strikes, and the ball 10 is rotated after each strike. The test is conducted for up to 185 strikes or until the ball 10 cracks, whichever occurs first. The true roundness of the ball 10 is measured before and after receiving the series of blows and any deformation from the true roundness is reported as the average "out of round" measurement in the diameter of the ball 10. An average value from at least two balls is reported for each test result. The softball 10 of the present invention is highly stable and durable, having an "out of round" test measurement of only 0.10 inch or less and typically only 0.06 inch after a laboratory pound test equivalent to one complete game (185 blows). In that test, the weight employed was eight pounds and the drop distance was nine feet.

The Laboratory Test Procedure for Abrasion Resistance as this term is used in the specification and claims generally follows the ASTM Test Method D-1242-56, Resistance to Abrasion of Plastic Materials, that has been modified for use with a Taber Abraser sold by Teledyne. According to this test procedure, a sample disc of the material is cut to a diameter of 4¼ inches, weighed and mounted in the abraser fitted with abrading wheels having a rubber and abrasive grain composition. Two abrasive wheels are brought to bear against the sample of a force of 1000 grams and the sample is subject to the abrading action of the wheels for 1000 cycles. The sample is removed and reweighed. The weight loss is calculated as a percent of the original sample weight.

Use of the Laboratory Test Procedure for Abrasion Resistance on the cover material of the present invention shows an abrasion resistance 25–30 times greater than the resistance exhibited by conventional synthetic leather covers. The latter show an average weight loss during the abrasion test from fifteen samples of 0.582% with nine out of the fifteen (60%) of the samples exhibiting a weight loss of 0.90% or more. The plastisol covers 14 of the present invention exhibit an average abrasion weight loss of less than 0.1% with most materials showing a loss of less than 0.05%, typically about 0.02–0.03%.

The softball 10 of the present invention is made in the following manner. 100 parts of a polyether polyol are mixed with 33–40, and preferably 35–38, parts of isocyanate by high pressure impingement mixing, low pressure mechanical mixing, or any other suitable mixing technique. The polyol, which is entirely a polyether polyol, and the isocyanate are thoroughly mixed, and about 128–136 grams of the mixture are placed in a spherical mold having an appropriate internal diameter. The mixture, which contains about 0.46–0.5% water as a blowing agent, is cured under conditions sufficient to result in a core 12 having a C.O.R. in the range of about 0.30–0.40 and a compression of 0.06–0.07 inches. Typically, curing takes place at a mold temperature of 100°–125° C. for a period of 4–6 minutes. Subsequently, the polyvinyl chloride plastisol cover 14 is molded directly to the core 12 and adhered thereto. The softball 10 is then coated with a urethane protective coating 16.

Having generally described the invention, the following example is included for purposes of illustration so that the invention may be more readily understood and is in no way intended to limit the scope of the invention unless otherwise specifically indicated.

EXAMPLE

A polyether polyol designated as BASF NB 13407-3-49-3 (BASF, Livonia, Mich.) is mixed with an isocyanate designated as BASF WUC 3238T in a mix ratio of 100 parts polyol to 36.5 parts isocyanate. The polyol is at a temperature of 40° C., while the isocyanate is at 37° C. The materials are mixed in a high pressure impingement mixing machine utilizing an "L" design mixing head. The mixing orifice size for the polyol is 0.65 mm, and the mixing orifice size for the isocyanate is 0.40 mm. The polyol is pumped at a pressure of 140–160 bar, while the isocyanate is pumped at 120–140 bar. A steel mold is provided having an internal diameter of 3.740 inches. The shot weight, i.e., the weight of mix material dispensed into the center of the mold, is about 128–136 grams. The shot time, i.e. the duration of time required to dispense this weight, is about 1.50–2.25 seconds. The amount of time from the end of the dispensing stage until removal of the cured core from the mold is about 4–6 minutes. Water within the mixture acts as a foaming agent to provide a foam free rise density of 11–13 pounds/foot$^3$. The resultant core has a compression of 0.065 inch and a C.O.R. of 0.37.

The core is then covered by molding the cover in situ over the core. A polyvinyl chloride plastisol mix is prepared from 100 parts by weight of a polyvinyl chloride homopolymer dispersion sold by Accidental Petroleum under the name Tenneco 1755, 60 parts by weight of diisononyl phthalate and about 8 parts by weight of a stabilizer composition. The mixture or blend was poured into a preheated hemispherical mold and the cover was formed using a slush cast and gel method. The plastisol was placed into both halves of the preheated mold to fill the mold. The plastisol was allowed to remain in the mold for a sufficient time for it to gel on the inner surface to reach the desired thickness of 0.05 inch. The excess plastisol was then removed from the mold and the preformed core was placed in the mold. The mold was closed and heat was applied to fuse the plastisol and bond it to the core. The mold was then cooled and the resultant ball removed therefrom. The cover had a thickness of 0.05 inch, a tensile strength of 1,600 psi, and a Shore A hardness of about 60–70. A polyurethane coating described in U.S. Pat. No. 5,091,265 was then sprayed over the cover. The resulting softball had a C.O.R. of 0.35.

The stability and durability of the resultant softballs was determined by striking the balls 185 times with an 8 pound weight dropped from nine feet. The roundness of the balls was measured before and after the blows were administered. The softballs were found to have a very low degree of deformation, i.e., an average "out of round" measurement of 0.07 inch.

The resultant balls also were tested for adhesion of the cover to the core. A standard size (1 inch) tab is cut from the cover and pull tested using an Instron tensile strength tester to determine the load required in pounds to cause a strip to be pulled off of the ball. No separation was evidenced using a 5 pound load. The adhesion is considered satisfactory if a 3 pound load provides no separation and a 5 pound or greater load is required to separate 90% of a strip extending around the entire circumference of the ball.

As will be apparent to persons skilled in the art, various modifications and adaptations of the structure above described will become readily apparent without departure from the spirit and scope of the invention.

What is claimed is:

1. A game ball having sufficient durability to withstand prolonged use on hard pavement, comprising:

a foam core formed from a mixture of a polyol and an isocyanate, the core having a compression of 0.06–0.07 inch when subjected to a force of 10 lbs. and a coefficient of restitution at 88 feet per second of less than 0.45, and a molded cover formed over the core, said cover including simulated stitching and having an average abrasion weight loss of less than 0.1% when subject to the Laboratory Test Procedure for Abrasion Resistance the ratio of the coefficient of restitution of the ball to the coefficient of restitution of the core being in the range of 0.90–0.99.

2. The game ball of claim 1, wherein the cover is molded directly over the core.

3. The game ball of claim 1, wherein the cover is made of polyvinyl chloride.

4. The game ball of claim 1, wherein the cover has a thickness of about 0.025–0.075 inch.

5. The game ball of claim 4, wherein the core has a coefficient of restitution at 88 feet per second within the range of 0.30–0.40.

6. The game ball of claim 1, wherein the core contains 33–40 parts of isocyanate per 100 parts of polyol.

7. The game ball of claim 1, wherein the cover has a Shore A hardness of about 60–70.

8. The game ball of claim 7, wherein the cover has a thickness of about 0.025–0.075 inch.

9. The game ball of claim 1, wherein the cover has a tensile strength of about 1,400–1,800 psi.

10. The game ball of claim 1, wherein the cover has an ion weight loss of less than 0.05% when subject to the Laboratory Test Procedure for Abrasion Resistance.

11. The game ball of claim 1, wherein the ratio of the coefficient of restitution of the ball to the coefficient of the restitution of the core is in the range of about 0.95–0.99.

12. The game ball of claim 11, wherein the cover has a thickness of about 0.025–0.075 inch.

13. The game ball of claim 1, further comprising a thin polyurethane film coating formed over the cover.

14. The game ball of claim 1, wherein the core has a coefficient of restitution at 88 feet per second within the range of 0.30–0.40.

15. The game ball of claim 1, wherein the cover is formed directly over the foam core and is secured thereto.

16. A game ball according to claim 1, wherein the game ball is a softball.

17. The game ball of claim 16, wherein the cover has a thickness of about 0.025–0.075 inch.

18. A game ball according to claim 16, wherein the game ball has a circumference of 11⅞–12½ inches.

19. A game ball according to claim 16, wherein the cover has a Shore A hardness of 60–70.

20. A game ball according to claim 19, wherein the cover has a tensile strength of 1,400–1,800 p.s.i.

* * * * *